US010040673B1

(12) United States Patent
Wendinger et al.

(10) Patent No.: US 10,040,673 B1
(45) Date of Patent: Aug. 7, 2018

(54) BOAT LIFT DRIVE

(71) Applicant: Nicholas A. Gargaro, III, Lino Lakes, MN (US)

(72) Inventors: David M. Wendinger, Isanti, MN (US); Nicholas A. Gargaro, III, Coon Rapids, MN (US)

(73) Assignee: Nicholas A. Gargaro, III, Coon Rapids, MN (US)

( * ) Notice: Subject to any disclaimer, the term of this patent is extended or adjusted under 35 U.S.C. 154(b) by 56 days.

(21) Appl. No.: 13/902,351

(22) Filed: May 24, 2013

Related U.S. Application Data

(60) Provisional application No. 61/652,303, filed on May 28, 2012.

(51) Int. Cl.
*B66D 1/14* (2006.01)

(52) U.S. Cl.
CPC ..... *B66D 1/14* (2013.01)

(58) Field of Classification Search
USPC ..... 254/342
See application file for complete search history.

(56) References Cited

U.S. PATENT DOCUMENTS 2,297,912 A * 10/1942 Payson ..... B66D 1/14 254/347
2,351,060 A 6/1944 Mclauthlin
3,298,462 A * 1/1967 Morris ..... B66B 9/187 182/178.1
3,443,772 A * 5/1969 Prosser ..... B65H 75/425 114/254
3,658,299 A 4/1972 Sprague
3,773,294 A * 11/1973 Alcott ..... B66D 1/16 192/41 S
4,613,273 A 9/1986 Wagner
4,954,011 A 9/1990 Stenson
5,143,182 A 9/1992 Basta
5,211,124 A 5/1993 Reiser
5,284,325 A 2/1994 Sasaki et al.
5,660,373 A 8/1997 Maslo et al.
6,767,004 B1 7/2004 Davis
7,017,887 B1 3/2006 Verakis
7,226,041 B2 6/2007 Ledford
7,377,485 B2 5/2008 Davis
7,784,767 B2 8/2010 Gargaro, III et al.
8,192,126 B1 * 6/2012 Young ..... 414/10
8,196,899 B2 6/2012 Hager
2007/0200104 A1 8/2007 Davis
2010/0187488 A1 7/2010 Gargaro, III et al.
2011/0027006 A1 * 2/2011 Hausladen ..... B66C 23/86 403/2
2011/0049450 A1 3/2011 Hager
2011/0214960 A1 * 9/2011 Bosk ..... F16D 43/20 192/56.1

* cited by examiner

*Primary Examiner* — Sang K Kim
*Assistant Examiner* — Nathaniel L Adams

(57) ABSTRACT

A boat lift drive for connection to a winch having a winch shaft. The boat lift drive includes a power unit, a drive train engaged to and being driven by the power unit, and a drive shaft engaged to and being driven by the drive train. The drive shaft in turn is engaged to and drives the winch shaft. The drive train includes a seat with a frustoconical section and the drive shaft includes a head with a frustoconical section. The frustoconical sections are press fit into each other. This frustoconical engagement provides a great amount of torque for lifting boats.

10 Claims, 4 Drawing Sheets

BOAT LIFT DRIVE

This application claims the benefit under 35 U.S.C. 119(e) of U.S. Provisional Patent Application No. 61/652,303 filed May 28, 2012. Such provisional application is hereby incorporated by reference in its entirety into this application.

FIELD OF THE INVENTION

The present invention generally relates to a boat lift drive, particularly to a boat lift drive having a drive shaft between a power unit and a winch, and specifically to a boat lift drive having a press fit engagement between the drive shaft and the power unit.

BACKGROUND OF THE INVENTION

A boat lift is a mechanism for lifting a boat at least partially out of the water and for securing the boat at a desired location, such as next to a dock. A boat lift mechanism may include a winch.

A winch is a mechanism that winds up or winds out a cable or tether or rope or wire to draw in or draw up or lift up or let out an object at the distal end of the cable. A winch may be hand powered, electric powered, hydraulically powered, pneumatically powered, powered by an internal combustion engine, or powered in some other fashion. A winch may include a mechanism to prevent reverse action of the winch (a winding out) and such a mechanism may be a ratchet and pawl, a solenoid brake, or a mechanical brake.

As indicated, a winch may be hand powered. These hand powered winches may have a hand wheel. Between the hand wheel and the winch, these hand powered winches may further have a winch shaft. When the hand wheel is removed from the winch shaft, an end of the winch shaft is exposed. The end of the winch shaft may include an exterior threaded portion and an interior threaded portion. The interior threaded portion may be a threaded opening that is coaxial with the exterior threaded portion and the winch shaft.

As further indicated, a winch may be electrically powered. For example, the Davis U.S. Pat. No. 6,767,004 issued Jul. 27, 2004 and entitled Replacement Motorized Drive Unit For Boat Lifts discloses a disc that drives a mating disc on the winch box shaft. The Gargaro, III et al. U.S. Pat. No. 7,784,767 issued Aug. 31, 2010 and entitled Boat Lift Drive discloses a drive shaft that includes an interior threaded opening that engages a threaded end of the winch shaft to directly connect the drive shaft to the winch shaft. The Hager U.S. Patent Application Publication No. US 2011/0049450 A1 published Mar. 3, 2011 and entitled Boat Lift Motor Having Spline Shaft discloses a worm gear reducer that rotates a tubular drive shaft having radial splines.

SUMMARY OF THE INVENTION

A feature of the present invention is the provision in a boat lift drive, of a power unit, a drive train, and a drive shaft adapted for connection to a winch that lifts a boat, where the drive train includes one of a seat and a head, where the drive shaft includes the other of the seat and the head, and where the head is press fit into the seat to provide a press fit driving engagement between the drive train and the drive shaft.

Another feature of the present invention is the provision in such a boat lift drive, of the drive train having the seat and of the drive shaft having the head.

Another feature of the present invention is the provision in such a boat lift drive, of the drive train having the head and of the drive shaft having the seat.

Another feature of the present invention is the provision in such a boat lift drive, of the head having a tapering sidewall section, of the seat having a tapering sidewall section, and of the tapering sidewall sections engaging each other to drive the winch.

Another feature of the present invention is the provision in such a boat lift drive, of the head having a frustoconical section, of the seat having a frustoconical section, and of the frustoconical sections engaging each other to drive the winch.

Another feature of the present invention is the provision in such a boat lift drive, of a pin or bolt extending from a gear unit having a frustoconical seat, where the pin runs from the gear unit, through the frustoconical head seated in the frustoconical seat, through the drive shaft having the frustoconical head, and into an opening in the winch shaft where the distal end of the pin is engaged, and where the pin can be tightened to draw the gear unit closer to the winch shaft and thereby draw the frustoconical seat and frustoconical head more tightly together in the axial direction.

Another feature of the present invention is the provision in such a boat lift drive, of a pin or bolt extending from a gear unit having a frustoconical seat, where the pin runs from the gear unit to the drive shaft where the distal end of the pin is engaged such that a tightening of the pin incrementally draws the frustoconical head of the drive shaft into the frustoconical seat of the gear unit in the axial direction.

Another feature of the present invention is the provision in such a boat lift drive, of the gear unit being constructed to have an axial opening that is sufficiently large to permit the free passage therethrough of a relatively narrow tie-in pin to tie the frustoconical head to the frustoconical seat and that is sufficiently small to threadingly mate with a relatively wide pusher pin that can incrementally push the frustoconical head out of the frustoconical seat in the axial direction.

An advantage of the present invention is that a great amount of torque may be transmitted to the winch for raising relatively heavy boats. The tapering smooth fit between the frustoconical seat and frustoconical head provides a tight fit over a great amount of surface area. In contrast, a spline engagement provides an edge to edge fit over a minimum amount of surface area between edges that can break or be chipped.

Another advantage of the present invention is that installation is simple, quick and easy. First, the distal end of the drive shaft is screwed onto the pre-existing winch shaft. This leaves the proximal end of the drive shaft having the frustoconical head exposed and accessible. Then, the boat lift drive, a rather heavy assembly having the frustoconical seat, is lifted to the height of the drive shaft and the frustoconical seat is slipped onto the frustoconical head. Then the boat lift drive, now supported by the drive shaft, may be further anchored to a portion of the frame of the winch. There is no need, such as in the case of a spline apparatus, to rotate the heavy boat lift in one direction or the opposite direction until there is a mating of the splines.

Another advantage of the present invention is that operation commences immediately in either direction of rotation. There is no play between a frustoconical seat and frustoconical head. In contrast, spline engagements typically have at least a small amount of play between forward and reverse direction, where one splined part rotates freely in the opposite direction until it bites, whereupon such rotation is transmitted into its mating splined part.

Another advantage of the present invention is that removal of the boat lift drive is simple, quick and easy. Either the drive shaft or the seat may be pushed or tapped in the axial direction, away from the direction of engagement, to separate the frustoconical head from the frustoconical seat. For example, the gear unit can have a through hole that is at least partially threaded. A bolt or pin can be threaded into the through hole until the distal end of the bolt engages the frustoconical head. Then the bolt or pin can be further turned to incrementally break the bond between the frustoconical head and seat or, if desired, the head of the bolt can then be tapped to break the bond between the frustoconical head and the frustoconical seat.

Another advantage is that the boat lift drive is relatively inexpensive to manufacture. For instance, a drive shaft having a frustoconical head and a drive train having a frustoconical seat are easier and less expensive to manufacture than splined parts.

DETAILED DESCRIPTION

Figure 1A:
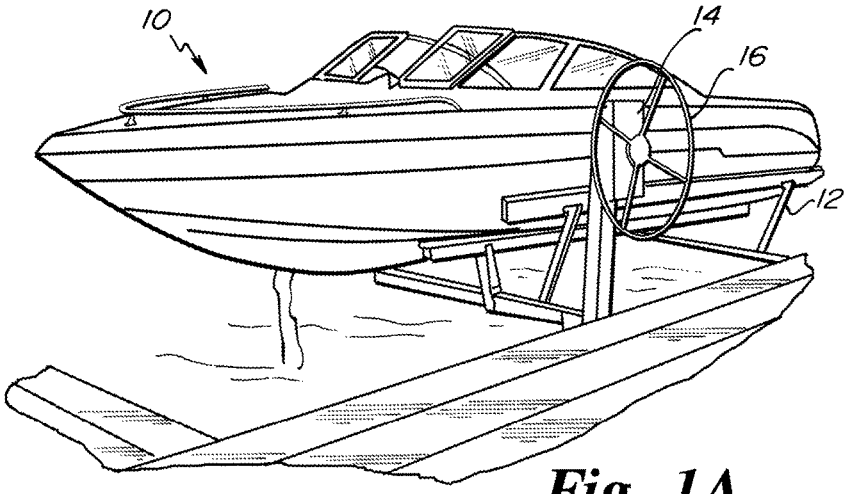
Fig. 1A (PRIOR ART)
FIG. 1A (prior art) is a perspective view of a boat, a boat lift, a dock and a winch driven by a hand wheel.

FIG. 1A shows a boat 10 on a boat lift 12. The boat 10 may be raised out of the water and lowered into the water by a winch 14 that raises and lowers the boat lift 12 and that is operated by a hand wheel 16.

The hand wheel 16 of the winch 14 of FIG. 1A may be removed. Upon removal of the hand wheel 16, a winch shaft 18 is exposed. Winch shaft 18 is shown in FIGS. 2, 3A, 3B, 4A and 4B.

An end of the winch shaft 18 includes an exterior threaded portion 20 and an interior threaded portion 22. Exterior and interior threaded portions 20, 22 are on axis A. Winch shaft 18 includes an end 24. Interior threaded portion 22 is open and extends axially into winch shaft 18 from end 24. Interior threaded portion 22 is a threaded hole. Exterior threaded portion 20, interior threaded portion 22, and winch shaft 18 are coaxial with each other.

Figure 1B:
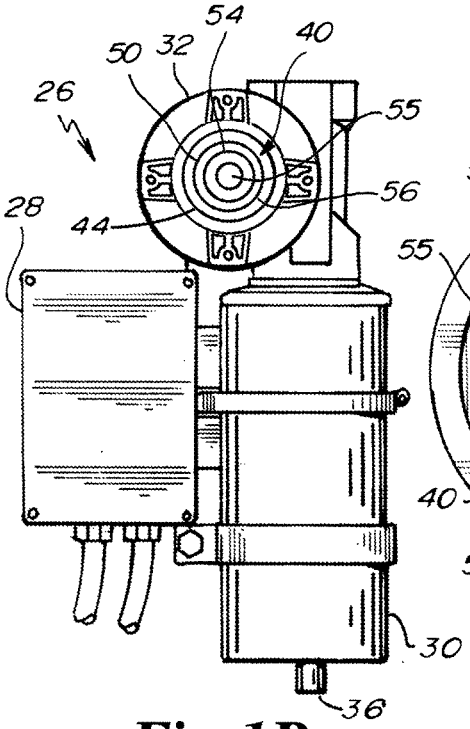
FIG. 1B shows the rear of the present boat lift drive that replaces the hand wheel of the winch of FIG. 1A and shows the frustoconical seat.
Figure 1C:
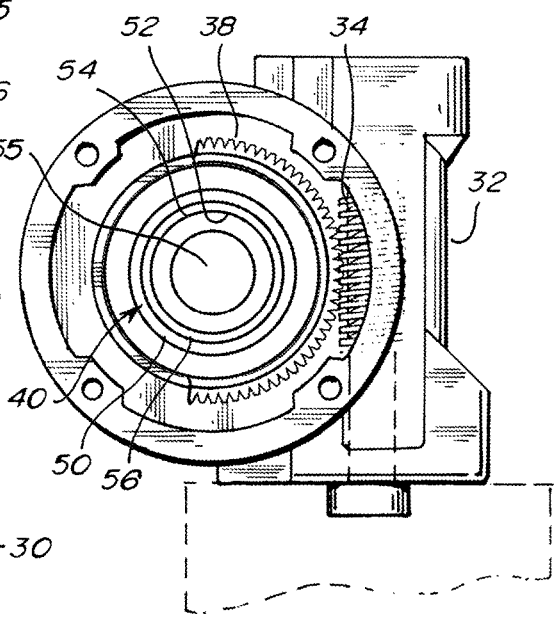
FIG. 1C is a detail, partially broken apart view of the gear unit of FIG. 1B and shows a worm gear driving the frustoconical seat.

As shown in FIG. 1B, the present boat lift drive is indicated by reference numeral 26. Boat lift drive 26 includes a control unit 28, a power unit 30, and a gear assembly or gear unit 32.

The control unit 28 may include operating mechanisms such as a key mechanism that turns the boat lift drive 26 on and off and that further controls the direction or rotation of winch 14 such that the key mechanism controls whether the boat 10 is lowered into the water or drawn out of the water. These operating mechanisms are disposed on the face opposite to that which is shown in FIG. 1B.

FIGS. 1B, 1C, 2, 3A, 3B, 4A, and 4B show the gear assembly or gear arrangement or gear unit 32. The gear unit 32 includes a worm 34 journaled in the unit 32 and driven by a power shaft 36 in the power unit 30 in either of the directions of rotation. Power unit 30 includes an electric motor that drives the power shaft 36 that drives the worm 34.

Worm 34 in turn drives a worm gear or worm wheel or rotatable gear 38 in either of the directions of rotation. Worm wheel 38 is one-piece with a core 40 such that rotation of worm wheel 38 drives core 40 and such that rotation of core 40 drives worm wheel 38. Worm wheel 38 and core 40 are coaxial. Worm wheel 38 and core 40 are journaled in the gear unit 32 by a pair of bearings 42. The bearings 42 may have rollers or balls therein as rolling elements. Each of the ends of the core 40 confronts an annular sealing gasket 44. Each of the annular sealing gaskets 44 is set in a disk like end 46 of worm gear unit 32.

Core 40 includes a proximal end 48 and a distal end 50. Distal end 50 may be referred to as the distal end of a drive train driven by the power unit 30, where the drive train includes the power shaft 36, worm 34, worm wheel 38, and core 40.

Proximal end 48 of core 40 includes a cylindrical opening 52 formed therein. A cylindrical piece 54 is rigidly fixed in the cylindrical opening 52. When core 40 rotates, cylindrical piece 54 rotates. Cylindrical piece 54 includes a through opening 55 formed therein. A portion of the through opening 55 may be threaded. Through opening 55 is aligned on axis A.

Distal end 50 of core 40 includes a frustoconical opening or seat 56 formed therein. Frustoconical seat 56 leads into cylindrical opening 52 having cylindrical piece 54 fixed rigidly therein. Cylindrical opening 52 extends about one-half the length of the core 40. Frustoconical seat 56 extends about one-half the length of the core 40.

Proximal end 48 of core 40 includes a flat annular face 58 surrounding the cylindrical opening 52. Annular face 58 is disposed at a right angle to the inner sidewall forming cylindrical opening 52. Face 58 is flush with a face 59 of cylindrical piece 54.

Distal end 50 of core 40 includes a flat annular face 60 surrounding the frustoconical opening or seat 56. Annular face 60 runs parallel to annular face 58. Annular face 60 and the tapering endless sidewall forming seat 56 form an oblique angle where "oblique" means an angle that is not 90 degrees but more or less than 90 degrees. "Oblique" means "neither parallel nor at a right angle to a specified or implied line; slanting."

When the worm 34 turns the worm wheel 38, the core 40 turns. When the core 40 turns, the frustoconical seat 56 turns.

The frustoconical seat 56 engages and drives a drive shaft 62. Drive shaft 62 includes a proximal end 64 and a distal end 66.

The proximal end 64 of the drive shaft 62 includes a frustoconical head 68. Frustoconical head 68 includes an endless tapering sidewall 70 and a flat front circular face 72. Frustoconical head 68 includes a rear annular face 69 running parallel to the front face 72. The connection between the frustoconical head 68 and the frustoconical seat 56 can be referred to as a proximal engagement of the drive shaft 62.

Drive shaft 62 is aligned on axis A. Sidewall 70 tapers toward axis A in a direction away from the distal end 66 of the drive shaft 62.

Frustoconical seat 56 is aligned on axis A. The sidewall forming the seat 56 tapers toward axis A in a direction away from the distal end 66 of the drive shaft 62 and in a direction toward the proximal end 48 of the core 40.

The distal end 66 of the drive shaft 62 includes a hexagonal portion 74 such that drive shaft 62 can be tightened on winch shaft 18 with an open end or adjustable end wrench. Each of the six flat surfaces on the hexagonal portion 74 runs parallel to axis A. Hexagonal portion 74 includes a flat annular end face 75. The connection between the hexagonal portion 74 and the winch shaft 18 can be referred to as a distal engagement of the drive shaft 62.

Drive shaft 62 includes a through opening 76 running in the axial direction through drive shaft 62 from the proximal end 64 to the distal end 66. At the proximal end of the drive shaft 62, the through opening 76 leads into the drive shaft 62 through face 72. At the distal end of the through opening 76, the through opening 76 includes interior threads 78 to mate with exterior threaded portion 20 of the winch shaft 18. Through opening 76 opens out through flat annular end face 75.

Drive shaft 62 includes a neck 80 disposed between the frustoconical head 68 and the hexagonal portion 74. The neck 80 is cylindrical. The neck 80 includes a diameter less than the distance between any diametrically opposing outer surface points on the hexagonal portion 74. The neck 80 includes a diameter less than or equal to the diameter of the face 72 of the head 68. The purpose of the neck 80 is to visually separate the head 68 from the hexagonal portion 74 so as to determine the depth to which frustoconical head 68 is seated in frustoconical seat 56. In the preferred seated position, the rear annular face 69 of the frustoconical head 68 is adjacent to the face 60 of core 40 and is, generally, in a plane that is adjacent to or in a plane in which face 60 of core 40 lies. When the head 68 is seated at such depth into the seat 56, such an engagement provides sufficient torque for lifting relatively large boats.

Figure 3A:
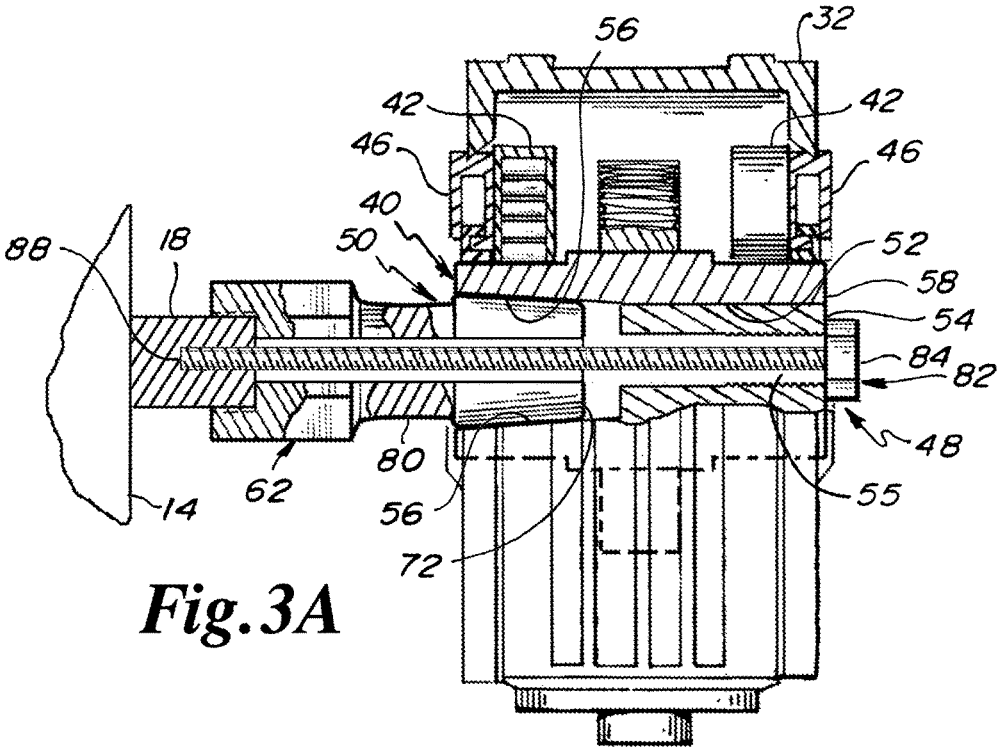
FIG. 3A is a side, partially broken apart view of the gear unit and winch shaft of FIG. 2, where a tie in bolt ties into the winch shaft.
Figure 3B:
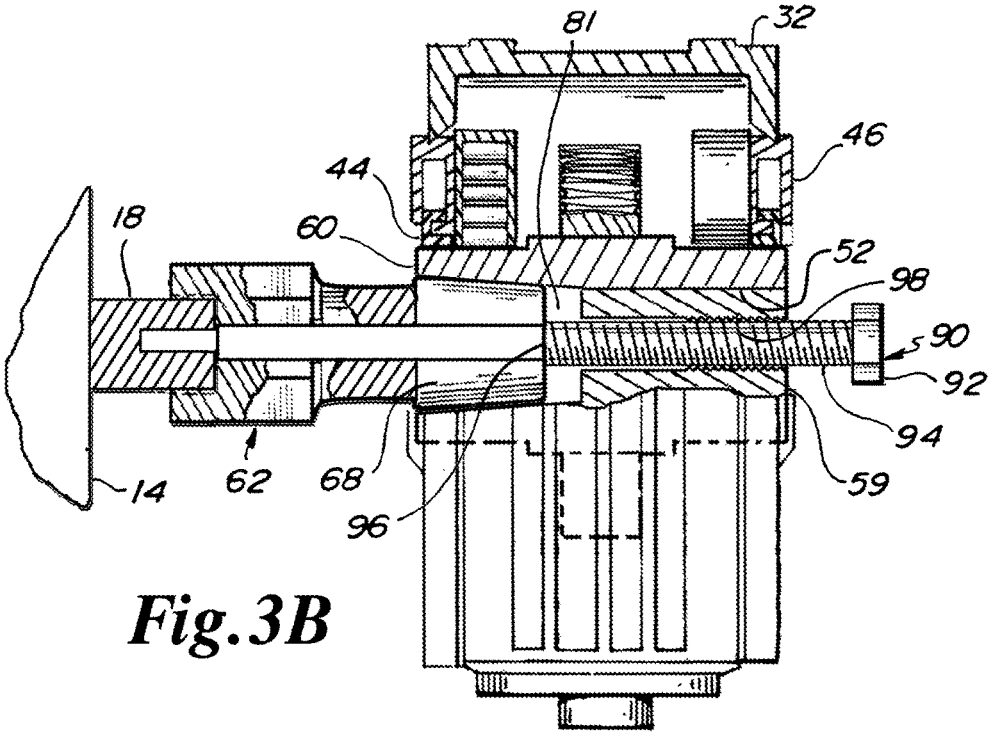
FIG. 3B is a side, partially broken apart view of the embodiment of FIG. 3A with the tie in bolt removed and with a pusher bolt installed for breaking the engagement between the frustoconical head of the drive shaft and the frustoconical seat of the core.

As shown in FIGS. 3A and 3B, the through opening 76 has two portions. A first portion is relatively narrow and runs through the head 68, the neck 80 and into the hexagonal portion 74. This first portion is not threaded. A second portion is relatively wide, includes the interior threads 78, and is disposed only in the hexagonal portion 74. This second portion receives the exterior threaded portion 20 of the winch shaft 18.

When the frustoconical head 68 is in the position where the faces 60, 69 are adjacent to each other, the face 72 of the head 68 is 1) spaced from the proximal end of the frustoconical seat 56 by a space 81, and 2) spaced from the distal end of the cylindrical piece 54 by the space 81. The proximal end of the frustoconical seat 56 and the distal end of the cylindrical piece 54 are adjacent to each other. With such spacing, the frustoconical head 68 can be drawn even further into the frustoconical seat 56 for the transmission of even greater torque.

The boat lift drive 26 further includes a pin 82. Pin 82 includes a head 84, a shaft 86, and a threaded distal end portion 88. Pin 82 is aligned on axis A. Pin 82 extends from the proximal end of the cylindrical piece 54 to the winch shaft 18. Head 84 of the pin 82 abuts the proximal end or face 59 of the cylindrical piece 54. Pin 82 then passes through opening 55 of the cylindrical piece 54, opening 76 of drive shaft 62 and into winch shaft 18 where the threaded distal end portion 88 engages the interior threaded portion 22 of the winch shaft 18. Pin 82 does not engage threads that may be formed in cylindrical piece 54 or drive shaft 62. Pin 82 rotates with the core 40, with the drive shaft 62, and with the winch shaft 18. Pin 82 does not engage any threads in the drive shaft 62 such that the frustoconical head 68 and frustoconical seat 56 can be drawn toward each other when the pin 82 is tightened into the winch shaft 18. Pin 82 then engages, as indicated above, the interior threaded portion 22 of the winch shaft 18, and when tightened draws the core 40 and drive shaft 62 relatively together, thereby drawing the frustoconical head 68 and frustoconical seat 56 relatively together.

Figure 2:
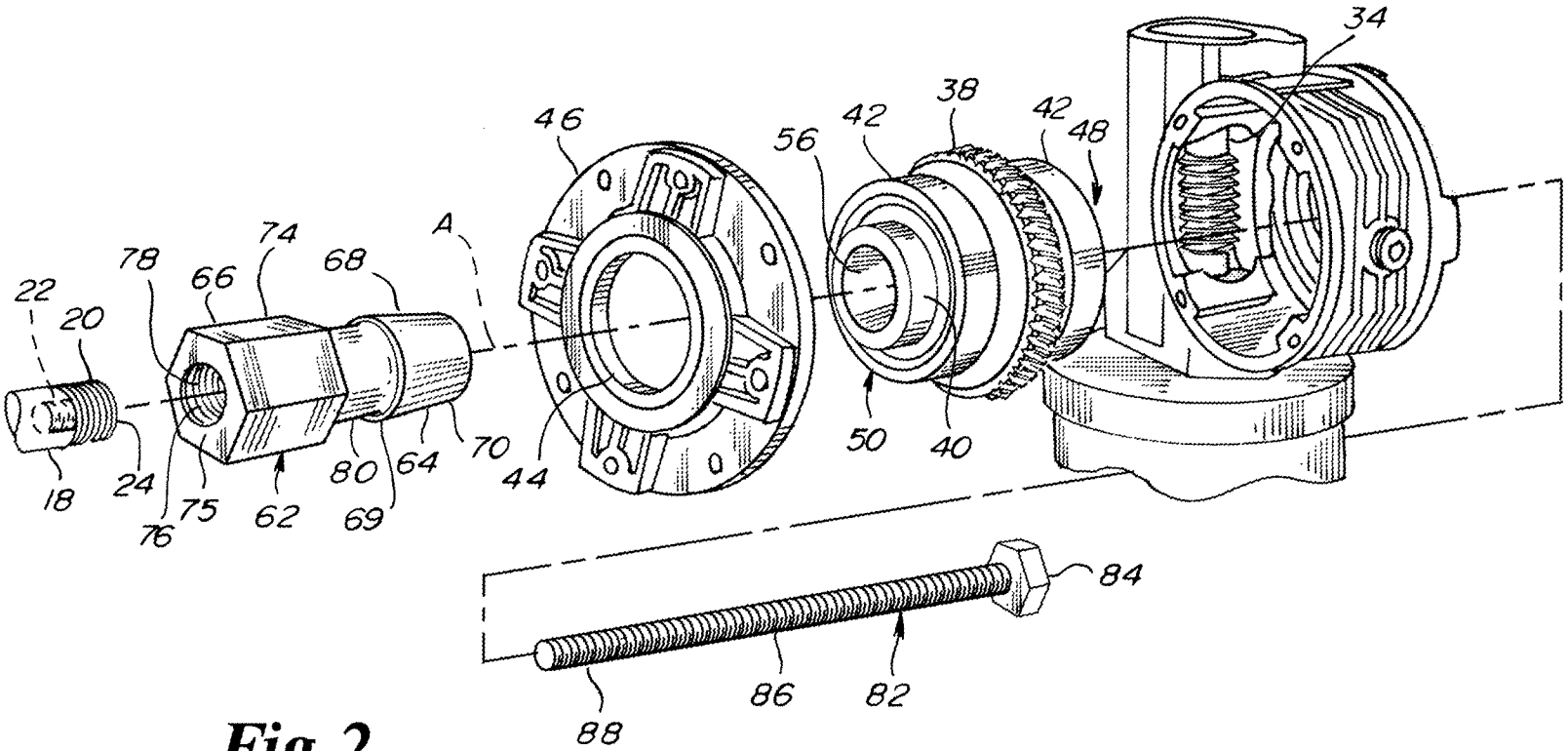
FIG. 2 is an exploded, detail view of the gear unit of FIG. 1C and further shows, in sequence, the pre-existing winch shaft, the drive shaft that screws onto the winch shaft and includes a frustoconical head, a cover plate for the gear unit, a core having the frustoconical seat and a worm wheel, a housing for the core and worm gear, and a bolt that runs through the core and drive shaft and ties into the pre-existing winch shaft.

A number of parts or features of the boat lift drive 26 are coaxial with axis A, shown in FIG. 2. These parts and features include pin 82, opening 55 of cylindrical piece 54, cylindrical piece 54, core 40, worm wheel 38, frustoconical seat 56, drive shaft 62, frustoconical head 68, hexagonal portion 74, and through opening 76 of the drive shaft 62.

Although preferred, bolt or pin 82 is not required in the operation of the boat lift drive 26. Gear unit or gear assembly 32 can be bolted to the winch 14 by using the housing or casing of the gear unit or gear assembly 32. When boat lift drive 26 is operated, the frustoconical seat 56 when driven to spin self-tightens onto the frustoconical head 68.

The portion of the core 40 that forms the frustoconical seat 56, that forms the cylindrical opening 52, that includes proximal face 58, and that includes distal face 60 is formed of steel. The drive shaft 62 is formed of steel such that the frustoconical head 68 is formed of steel. The engagement between the frustoconical seat 56 and frustoconical head 68 is a steel on steel engagement. This is a press fit engagement that becomes stronger when the head 68 is drawn in the axial direction along axis A toward the deepest or most narrow end of the seat 56. This engagement may be referred to as a locking friction fit engagement. There is no need for splines, indexing or keys. This engagement can be referred to as a tapered shaft drive interface.

In operation, to install the boat lift drive 26, the hand wheel 16 is removed. When the hand wheel 16 is removed, the winch shaft 18, the exterior threaded portion 20 of the winch shaft 18, and the interior threaded portion 22 of the winch shaft 18 are exposed and accessible for use by the boat lift drive 26. Then the drive shaft 62 is screwed onto the winch shaft 18 such that the interior threads 78 of the distal end 66 of the drive shaft 62 mate with the exterior threaded portion 20 of the winch shaft 18 and such that the frustoconical head 68 is exposed for engagement by the frustoconical seat 56. Then the boat lift drive 26, including the control unit 28, power unit 30, and gear unit 32 is lifted up as one unitary piece and the frustoconical seat 56, a part of this one unitary piece, is placed upon the frustoconical head 68. Since the frustoconical seat 56 and head 68 have no splines but instead have smooth tapering sidewalls, there is no need to rotate or tilt the massive boat lift drive 26 so as to, for instance, align splines. Thus the massive boat lift drive 26 can be quickly engaged to the frustoconical head 68. After such engagement, the pin 82 can be inserted into the core 40, through the drive shaft 62 and tightened into the winch shaft 18, thereby drawing the frustoconical head 68 and frustoconical seat 56 into an engagement with each other that drives the drive shaft 62 that in turn drives the winch shaft 18 that drives the winch 14. It should be noted that portions of the boat lift drive 26 can be anchored to posts or other structural portions of the winch 14.

Then, to operate the boat lift 12, controls on the control panel 28 are operated. The boat 10 may be raised and lowered. The connection between the frustoconical seat 56 and frustoconical head 68 provides for a driving of the drive shaft 62 in either direction of rotation.

To remove the boat lift drive 26 from the winch 14, the pin 82 is turned so that the distal end 88 is threaded out of the interior opening 22 of the winch shaft 18. Then the face 58 of the proximal end 48 of the core 40 may be tapped with a hammer in a direction away from the winch shaft 18 so as to break an engagement between the frustoconical head 68 and frustoconical seat 56 and dislodge the head 68 from the seat 56. Then the control unit 28, power unit 30, and gear unit 32 may be removed from the drive shaft 62, and other connections between the winch 14 on the one hand and the control unit 28, power unit 30 and gear unit 32 may be removed as well. Then, if desired, the drive shaft 62 may be screwed off the winch shaft 18.

FIG. 3B shows an alternate method of breaking the connection between the frustoconical head 68 and frustoconical seat 56. In this method, a pusher pin 90 is employed. Pusher pin 90 includes a head 92, a threaded shaft 94 and a distal end 96. The threaded shaft 94 mates with threads 98 formed on the interior of cylindrical piece 54. To break the connection between the head 68 and seat 56, the pusher pin 90 is turned and the distal end 96 abuts the face 72 of the head 68 about the through opening 76 of the drive shaft 62, thereby incrementally and slowly separating the head 68 from the seat 56. The outside diameter of the distal end 96 of pusher pin 90 is greater than the outside diameter of the through hole 76 that opens through the front face 72 of the frustoconical head 68.

Figure 4A:
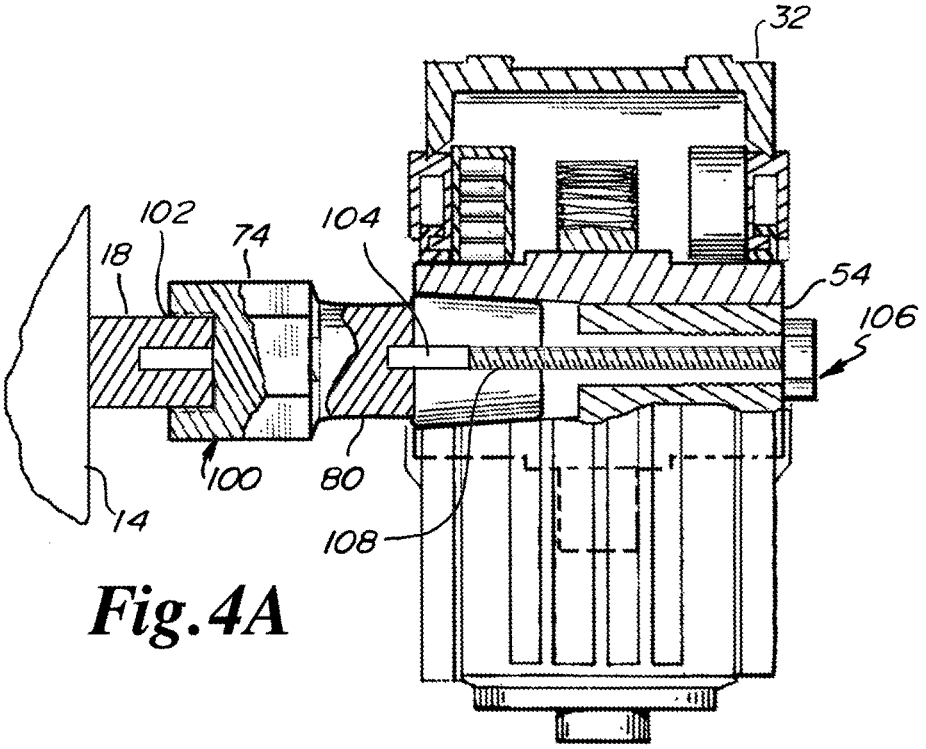
FIG. 4A is a side, partially broken apart view of another embodiment of the gear unit and winch shaft of FIG. 3A, where a tie in bolt ties into the drive shaft instead of the winch shaft.

FIG. 4A shows an alternate embodiment of the drive shaft 62 and pin 82. Instead of drive shaft 62, a drive shaft 100 is employed. Drive shaft 100 is identical to drive shaft 62 except that 1) drive shaft 100 does not include through opening 76, 2) drive shaft 100 includes a distal end threaded opening 102 for mating with the winch shaft 18, and 3) drive shaft 100 includes a threaded proximal end opening 104. Instead of pin 82, threaded pin 106 is employed. Pin 106 is identical to pin 82 except that pin 106 is shorter in length than pin 82. Pin 106 includes a threaded distal end 108 that mates with proximal end opening 104 such that pin 106 can draw the head 68 of drive shaft 100 into the seat 56. Pin 106 does not threadingly engage cylindrical piece 54.

Figure 4B:
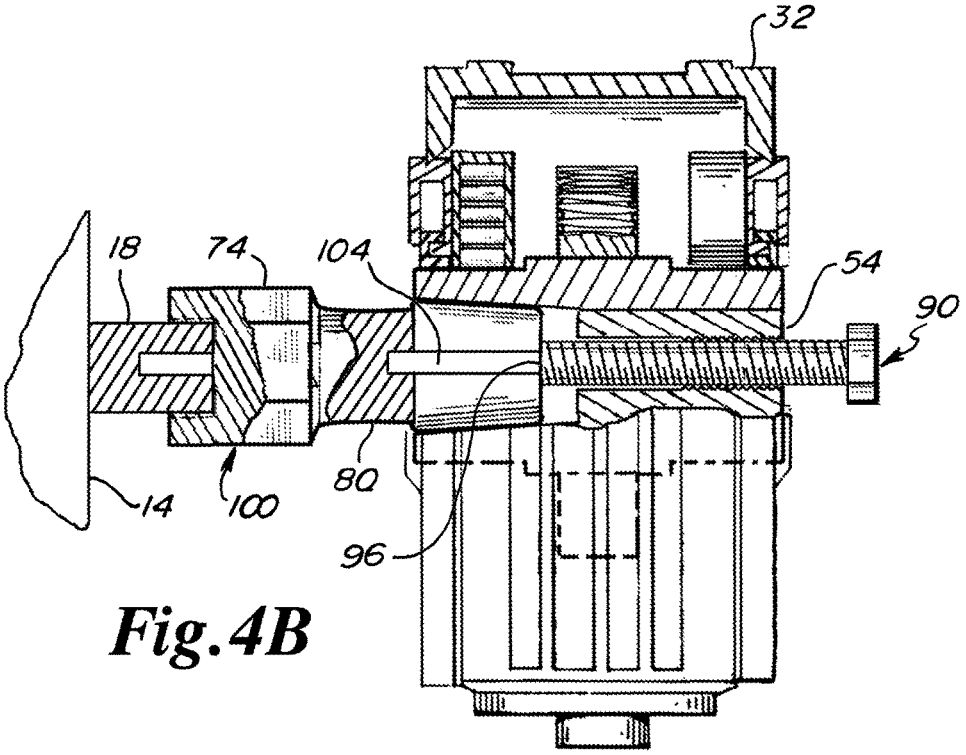
FIG. 4B is a side, partially broken apart view of the embodiment of FIG. 4A with the tie in bolt removed and with a pusher bolt installed for breaking the engagement between the frustoconical head of the drive shaft and the frustoconical seat of the core.

FIG. 4B shows pusher pin 90 about to break the connection between the head 68 of drive shaft 100 and seat 56. The diameter of the distal end 96 is greater than the diameter of the opening 104 at face 72 of head 68 of drive shaft 100.

It should be noted that, with the embodiment of drive shaft 100 and pin 106 shown in FIG. 4A, it is possible to unscrew pin 106 until the underside of the head of pin 106 is spaced from face 59 of cylindrical piece 54 and then tap the head of pin 106 with a hammer. However, this method of breaking the connection between the head 68 of drive shaft 100 and seat 56 may damage the threads between the distal end 108 of pin 106 and the threads forming the opening 104.

If desired, the distal end 96 of pusher pin 90 may be concave so as to maximize contact between end 96 and face 72 at points spaced from where opening 104 leads out of face 72, so as to minimize contact between end 96 and face 72 where opening 104 leads out of face 72, and so as to preserve the integrity of threads forming the opening 104.

In an alternate embodiment, the drive shaft 62 may include the frustoconical seat 56 and the core 40 may include the frustoconical head 68. In this embodiment, the frustoconical head 68 may protrude from the face 60 of the core 40. In this embodiment, the head 68 may be one-piece and integral with a piece such as cylindrical piece 54. In this embodiment, the cylindrical opening 52 may run the length of the core 40 and the cylindrical piece 54 may run the length of the core 40, with the head 68 protruding from the face 60 of the core. In this embodiment, the neck 80 of the drive shaft 62 may be eliminated to keep the driveshaft 62 of the same length such that the boat lift drive 26 is kept the same distance from the winch 14. In this embodiment, the pin 82 is kept the same length and still extends through the core 40, drive shaft 62, and into the end of the winch shaft 18.

Frustoconical generally means the frustum or basal part of a solid cone formed by cutting off the top by a plane parallel to the base or the part of the solid cone intersected between two parallel planes. When used herein, a frustoconical head means that the endless sidewall of the head has the shape of the endless sidewall of a frustum of a cone. A frustoconical head does not require that the head be solid throughout. A frustoconical head does not require that the head have two faces in parallel planes. Further, when used herein, a frustoconical seat means that the endless sidewall of the seat has the shape of the endless sidewall of a frustum of a cone. A frustoconical seat does not require that the seat be solid throughout; here, the seat is a receptor or cavity for the frustoconical head. A frustoconical seat does not require that the seat have two faces in parallel planes; here, what otherwise would be the distal parallel plane is an opening through which the head is inserted; here, what would otherwise be the proximal parallel plane is an opening into which the head can be further drawn to make the connection between the head and the seat even tighter.

The Gargaro, III et al. U.S. Pat. No. 7,784,767 issued Aug. 31, 2010 and entitled Boat Lift Drive is hereby incorporated by reference in its entirety into this application.

The proximal engagement between the proximal end 64 of the drive shaft 62 and the distal end 50 of the drive train is a direct friction fit or direct press fit engagement between the tapering sidewall of the seat 56 and the tapering sidewall of the head 68 such that the drive train drives the drive shaft 62 by a direct friction fit or a direct press fit. The tapering sidewall or frustoconical section of the seat 56 directly engages the tapering sidewall 70 or frustoconical section 70 of the head 68. The frustoconical sections of the seat 56 and head 68 are directly press fit into each other.

As shown in FIG. 2, the drive shaft 62 is one-piece and integral from the proximal end 64 of the drive shaft 62 to the distal end 66 of the drive shaft 62. The distal end 66 of the drive shaft 62 includes a set of flat surfaces. Each of the flat surfaces runs parallel to axis A and is exposed when the distal end 66 of the drive shaft 62 is engaged to the winch shaft 18 such that the distal end 66 of the drive shaft 62 is configured to be engaged by an open end wrench about 360 degrees of the distal end 66 of the drive shaft 62 when the distal end 66 of the drive shaft 62 is engaged to the winch shaft 18. The drive shaft 62 includes a neck 80 between the proximal and distal ends 64, 66 of the drive shaft 62 to visually separate the proximal and distal ends 64, 66 of the drive shaft 62. The neck 80 has a width less than a greatest width of each of the proximal and distal ends 64, 66 of the drive shaft 62.

The core 40 includes a through opening. The through opening includes a proximal end portion on the proximal end 48 of the core 40 and a distal end portion on the distal end 50 of the core 40. The proximal end portion 52 opens to an exterior of the core 40. The distal end portion opens to an exterior of the core 40 opposite of the proximal end portion. The core 40 includes a distal annular face 60 surrounding the distal end portion that opens to an exterior of the core. The seat 56 is disposed at the distal end portion such that the seat 56 having the tapering sidewall that is frustoconical opens to an exterior of the core 40. The tapering sidewall of the seat 56 is disposed at the distal end portion such that the tapering sidewall begins at the distal end portion. The drive shaft 62 includes a neck 80 between the proximal end 64 and the distal end 66 of the drive shaft 62. The head 68 of the drive shaft 62 includes a rear annular face 69. The neck 80 has a width less than a width of the rear annular face 69. The neck 80 leads immediately into the rear annular face 69. The rear annular face 69 leads immediately into a widest part of the head 68. The widest part of the head 68 tapers to a narrowest part of the head 68. The rear annular face 69 is adjacent to the distal annular face 60 of the core 40 when the head 68 is seated in the seat 56.

The tapering sidewall of the seat 56 terminates short of the proximal end portion of the through opening on the proximal end 48 of the core 40 such that the head 68 when seated in the seat 56 terminates short of the proximal end portion of the through opening on the proximal end 48 of the core 40.

The head 68 includes a front face 72 and a rear face 69. The head 68 tapers from the rear face 69 to the front face 72. The front face 72 of the head 68 terminates short of the proximal end opening of the through opening on the proximal end 48 of the core 40 when the head 68 is seated in the core 40. The rear face 69 of the head 68 is adjacent to the distal end portion of the through opening on the distal end 50 of the core 40 when the head 68 is seated in the seat 56.

The rear face 69 and the front face 72 are parallel to each other. The rear face 69 and the front face 72 are disposed at a right angle to the axis A of the drive shaft 62 and the seat 56. The rear face 69 is adjacent to the distal end portion of the through opening on the distal end 50 of core 40 when the head 68 is seated in the seat 56.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

We claim:

1. A boat lift drive for connection to a winch having a winch shaft, with the boat lift drive comprising:

a) a power unit;

b) a drive train engaged to and being driven by the power unit, wherein the drive train comprises a distal end;

c) a drive shaft comprising a proximal end and distal end, wherein the proximal end of the drive shaft is engaged to the distal end of the drive train by a proximal engagement, and wherein the distal end of said drive shaft is engaged to the winch shaft by a distal engagement;

d) wherein said distal end of said drive train comprises one of a seat and a head and wherein said proximal end of said drive shaft comprises the other of a seat and a head, the seat and head being on an axis and being coaxial with each other;

e) wherein the seat includes a tapering sidewall tapering toward the axis;

f) wherein the head includes a tapering sidewall tapering toward the axis;

g) wherein said proximal engagement is a direct friction fit engagement between said tapering sidewall of said seat and said tapering sidewall of said head such that said drive train drives said drive shaft by a direct friction fit;

h) wherein said tapering sidewall of said seat is frustoconical and smooth;

i) wherein said tapering sidewall of said head is frustoconical and smooth;

j) wherein said tapering sidewall of said seat directly engages said tapering sidewall of said head;

k) wherein the drive shaft is one-piece and integral from the proximal end of the drive shaft to the distal end of the drive shaft;

l) wherein the winch shaft includes an end, wherein the end of the winch shaft includes an exterior threaded portion, and wherein the distal end of the drive shaft includes an interior threaded portion that engages the exterior threaded portion of said end of said winch shaft;

m) wherein said distal end of said drive train includes said seat and wherein said proximal end of said drive shaft includes said head;

n) a core having a through opening;

o) said through opening having a proximal end portion and a distal end portion;

p) said proximal end portion opening to an exterior of said core, said distal end portion opening to an exterior of said core opposite of said proximal end portion;

q) said head having a front face and a rear face;

r) said head tapering from said rear face to said front face;

s) said front face of said head terminating short of the proximal end opening when said head is seated in said core; and t) said rear face of said head being adjacent to said distal end portion of said through opening of said core when said head is seated in said seat.

2. The boat lift drive of claim 1, wherein said drive shaft comprises a drive shaft axis running from the proximal end to the distal end of the drive shaft, wherein said distal end of said drive train comprises a drive train distal end axis that is coaxial with said drive shaft axis, and wherein said tapering sidewall of said seat tapers toward said drive train distal end axis and in a direction away from said distal end of said drive shaft.

3. The boat lift drive of claim 1, wherein said drive shaft comprises a drive shaft axis running from the proximal end to the distal end of the drive shaft, wherein said distal end of said drive train comprises a drive train distal end axis that is coaxial with said drive shaft axis, and wherein said tapering sidewall of said head tapers toward said drive shaft axis of said drive shaft and in a direction away from said distal end of said drive shaft.

4. The boat lift drive of claim 1, wherein said drive shaft comprises a drive shaft axis running from the proximal end to the distal end of the drive shaft, wherein said tapering sidewall of said seat is endless, and wherein said tapering sidewall of said seat surrounds an axis that is coaxial with said drive shaft axis.

5. The boat lift drive of claim 1, wherein said drive shaft comprises a drive shaft axis running from the proximal end to the distal end of the drive shaft, wherein said tapering sidewall of said head is endless, and wherein said tapering sidewall of said head surrounds an axis that is coaxial with said drive shaft axis.

6. The boat lift drive of claim 1, wherein the distal end of the drive shaft includes a hexagonal portion having a set of flat surfaces, each of the flat surfaces running parallel to said axis and being exposed when the distal end of the drive shaft is engaged to the winch shaft such that the distal end of the drive shaft is configured to be engaged by an open end wrench about 360 degrees of the distal end of the drive shaft when the distal end of the drive shaft is engaged to the winch shaft.

7. The boat lift of claim 1, wherein the drive shaft includes a neck between the proximal and distal ends of the drive shaft to visually separate the proximal and distal ends of the drive shaft, the neck having a width less than a greatest width of each of the proximal and distal ends of the drive shaft.

8. The boat lift of claim 1:

wherein said drive shaft includes a neck between said proximal and distal ends of the drive shaft, the neck having a width less than a greatest width of each of the proximal and distal ends of the drive shaft, said neck extending from the head at said rear face.

9. A boat lift drive for connection to a winch having a winch shaft, with the boat lift drive comprising:

a) a power unit;

b) a drive train engaged to and being driven by the power unit, wherein the drive train comprises a distal end;

c) a drive shaft comprising a proximal end and distal end, wherein the proximal end of the drive shaft is engaged to the distal end of the drive train by a proximal engagement, and wherein the distal end of said drive shaft is engaged to the winch shaft by a distal engagement;

d) wherein said distal end of said drive train comprises one of a seat and a head and wherein said proximal end of said drive shaft comprises the other of a seat and a head, the seat and head being on an axis and being coaxial with each other;

e) wherein the seat includes a tapering sidewall tapering toward the axis;

f) wherein the head includes a tapering sidewall tapering toward the axis;

g) wherein said proximal engagement is a direct friction fit engagement between said tapering sidewall of said seat and said tapering sidewall of said head such that said drive train drives said drive shaft by a direct friction fit;

h) wherein said tapering sidewall of said seat is frustoconical and smooth;

i) wherein said tapering sidewall of said head is frustoconical and smooth;

j) wherein said tapering sidewall of said seat directly engages said tapering sidewall of said head;

k) wherein the drive shaft is one-piece and integral from the proximal end of the drive shaft to the distal end of the drive shaft;

l) wherein the winch shaft includes an end, wherein the end of the winch shaft includes an exterior threaded portion, and wherein the distal end of the drive shaft includes an interior threaded portion that engages the exterior threaded portion of said end of said winch shaft;

m) wherein said distal end of said drive train includes said seat and wherein said proximal end of said drive shaft includes said head;

n) a core having a through opening;

o) said through opening having a proximal end portion and a distal end portion;

p) said proximal end portion opening to an exterior of said core, said distal end portion opening to an exterior of said core opposite of said proximal end portion;

q) said core including a distal annular face surrounding said distal end portion that opens to an exterior of said core;

r) said seat being disposed at the distal end portion such that said seat having said tapering sidewall that is frustoconical opens to an exterior of said core;

s) said tapering sidewall of said seat being disposed at the distal end portion such that said tapering sidewall begins at said distal end portion;

t) said drive shaft including a neck between the proximal end and the distal end of said drive shaft;

u) said head of said drive shaft including a rear annular face;

v) said neck having a width less than a width of the rear annular face;

w) said neck leading immediately into the rear annular face;

x) said rear annular face leading immediately into a widest part of said head;

y) said widest part of said head tapering to a narrowest part of the head; and z) said rear annular face of said head being adjacent to said distal annular face of said core when said head is seated in said seat.

10. The boat lift drive of claim 9, wherein said tapering sidewall of said seat terminates short of said proximal end portion of said through opening such that said head when seated in said seat terminates short of said proximal end portion of said through opening.

* * * * *